US009145766B2

(12) United States Patent
Fripp et al.

(10) Patent No.: US 9,145,766 B2
(45) Date of Patent: Sep. 29, 2015

(54) METHOD OF SIMULTANEOUSLY STIMULATING MULTIPLE ZONES OF A FORMATION USING FLOW RATE RESTRICTORS

(75) Inventors: Michael L. Fripp, Carrollton, TX (US); Jason D. Dykstra, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 495 days.

(21) Appl. No.: 13/445,378

(22) Filed: Apr. 12, 2012

(65) Prior Publication Data

US 2013/0269950 A1 Oct. 17, 2013

(51) Int. Cl.

| | |
|---|---|
| ***E21B 43/25*** | (2006.01) |
| ***E21B 43/16*** | (2006.01) |
| ***E21B 34/08*** | (2006.01) |

(52) U.S. Cl.

CPC ..... *E21B 43/25* (2013.01); *E21B 34/08* (2013.01); *E21B 43/162* (2013.01)

(58) Field of Classification Search

CPC ..... E21B 43/14; E21B 43/16; E21B 43/162; E21B 43/25

USPC ..... 166/305.1, 306, 307, 308.1, 177.5; 137/599.01

See application file for complete search history.

(56) References Cited

U.S. PATENT DOCUMENTS

| | | | | |
|---|---|---|---|---|
| 6,722,438 | B2 * | 4/2004 | Sask | 166/312 |
| 2004/0168800 | A1 * | 9/2004 | Sask | 166/279 |
| 2006/0243443 | A1 | 11/2006 | Matthews | |
| 2008/0035345 | A1 * | 2/2008 | Kosakewich | 166/302 |
| 2009/0114391 | A1 | 5/2009 | Smith, IV et al. | |
| 2009/0218103 | A1 * | 9/2009 | Aakre et al. | 166/373 |
| 2010/0263874 | A1 * | 10/2010 | Kosakewich | 166/308.1 |
| 2011/0240298 | A1 | 10/2011 | Rota et al. | |
| 2011/0297385 | A1 | 12/2011 | Dykstra et al. | |
| 2011/0308806 | A9 | 12/2011 | Dykstra et al. | |
| 2012/0292032 | A1 * | 11/2012 | Themig et al. | 166/310 |
| 2012/0312547 | A1 * | 12/2012 | Miller | 166/373 |
| 2013/0048298 | A1 * | 2/2013 | Merron et al. | 166/373 |
| 2013/0168090 | A1 * | 7/2013 | Themig et al. | 166/285 |

* cited by examiner

*Primary Examiner* — Elizabeth Gitlin
(74) *Attorney, Agent, or Firm* — McGuireWoods, LLP

(57) ABSTRACT

A method of simultaneously stimulating at least a first and second zone of a subterranean formation that includes flowing a fluid through multiple flow rate restrictors, with a first restrictor located adjacent the first zone, a second restrictor located adjacent the second zone, and the first and second restrictors are connected in parallel. As at least one of the fluid properties changes, the flow rates of the fluid exiting the first and second restrictors are similar within a flow rate range, and allowing the fluid to stimulate at least the first and second zones. As at least one of the properties of the fluid changes, the pressure differential between a fluid inlet and a fluid outlet increases and as the pressure differential increases, the flow rate of the fluid exiting the fluid outlet is maintained within the flow rate range.

16 Claims, 6 Drawing Sheets

METHOD OF SIMULTANEOUSLY STIMULATING MULTIPLE ZONES OF A FORMATION USING FLOW RATE RESTRICTORS

TECHNICAL FIELD

Methods of simultaneously stimulating at least two zones of a subterranean formation are provided. According to certain embodiments, at least one flow rate restrictor is located adjacent to each zone to be stimulated. According to another embodiment, the flow rate restrictors provide a flow rate into each zone within a flow rate range. The stimulation can be a fracturing or an acidizing treatment.

SUMMARY

According to an embodiment, a method of simultaneously stimulating at least a first zone and a second zone of a subterranean formation comprises: flowing a fluid through at least a first flow rate restrictor and a second flow rate restrictor, wherein: (A) the first flow rate restrictor is located adjacent to the first zone, (B) the second flow rate restrictor is located adjacent to the second zone, (C) the first and second flow rate restrictors are connected in parallel, and (D) as at least one of the properties of the fluid changes, the flow rates of the fluid exiting the first and second flow rate restrictors are similar within a flow rate range; and allowing the fluid to stimulate at least the first zone and the second zone.

According to another embodiment, a method of simultaneously stimulating at least a first zone and a second zone of a subterranean formation comprises: flowing a fluid through at least a first flow rate restrictor and a second flow rate restrictor, wherein: (A) the first flow rate restrictor is located adjacent to the first zone, (B) the second flow rate restrictor is located adjacent to the second zone, (C) the first and second flow rate restrictors are connected in parallel, (D) the first and second flow rate restrictors comprise a fluid inlet and a fluid outlet, (E) as at least one of the properties of the fluid changes, the pressure differential between the fluid inlet and the fluid outlet increases; and (F) as the pressure differential increases, the flow rate of the fluid exiting the fluid outlet is maintained within a flow rate range; and allowing the fluid to stimulate at least the first zone and the second zone.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
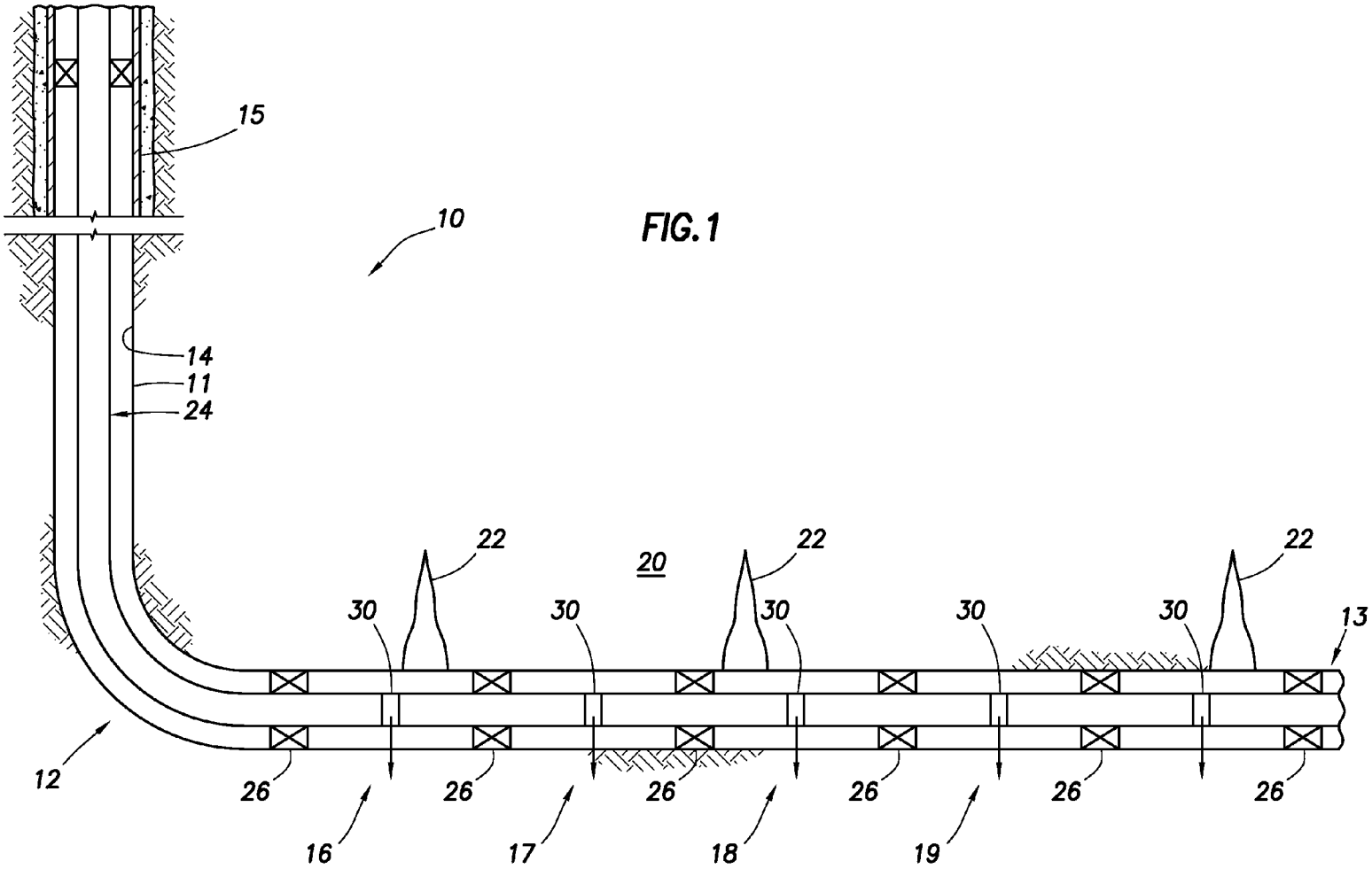
FIG. 1 depicts a well system containing multiple flow rate restrictors located within multiple zones of the well system.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more fluid passageways, zones, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase, whereas a heterogeneous fluid has more than one distinct phase. A colloid is an example of a heterogeneous fluid. A colloid can be: a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and liquid droplets as the dispersed phase.

Viscosity is an example of a physical property of a fluid. The viscosity of a fluid is the dissipative behavior of fluid flow and includes, but is not limited to, kinematic viscosity, shear strength, yield strength, surface tension, viscoplasticity, and thixotropicity. Viscosity is commonly expressed in units of centipoise (cP), which is 1/100 poise. One poise is equivalent to the units of dyne-sec/cm$^2$.

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

Stimulation techniques can be used to help increase or restore oil, gas, or water production. As used herein, the term "stimulate" means increasing the permeability of a subterranean formation. One example of a stimulation technique is hydraulic fracturing. In hydraulic fracturing, a fracturing fluid is pumped at a sufficiently high flow rate and high pressure through the wellbore and into the near wellbore region to create or enhance a fracture in the subterranean formation. Creating a fracture means making a new fracture in the formation. Enhancing a fracture means enlarging a pre-existing fracture or fissure in the formation. A frac pump is used to pump the fracturing fluid into the wellbore and formation at high rates and pressures, for example, at a flow rate in excess of 10 barrels per minute (4.20 U.S. gallons per minute) at a pressure in excess of 5,000 pounds per square inch ("psi").

A fracturing fluid is commonly a slurry containing undissolved solids of proppant. A newly-created or extended fracture will tend to close together after the pumping of the fracturing fluid is stopped. To prevent the fracture from closing, the proppant is placed in the fracture via the liquid continuous phase of the fluid to keep the fracture propped open.

Another example of a stimulation technique is an acidizing treatment. There are two types of acidizing treatments: matrix acidizing and fracturing acidizing. In matrix acidizing, acidizing is performed below the pressure necessary to fracture the formation in an effort to restore the natural permeability of the formation. Permeability refers to how easily fluids can flow through a material. For example, if the permeability is high, then fluids will flow more easily and more quickly through the subterranean formation. If the permeability is low, then fluids will flow less easily and more slowly through the subterranean formation. A matrix acidizing treatment is performed by pumping an acid into the well and into the pores of the formation. In this form of acidization, the acid dissolves the sediments and mud solids that are decreasing the permeability of the formation; thereby, enlarging the natural pores of the formation and stimulating flow of oil, gas or water. While matrix acidizing is done at a low enough pressure to keep from fracturing the formation, fracture acidizing involves pumping highly-pressurized acid into the well; thereby, fracturing the formation and also dissolving the sediments decreasing permeability.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. Each zone of the formation can be isolated within the wellbore via the use of packers or other similar devices.

It is often desirable to perform a stimulation technique at one or more locations within multiples zones of a formation. This is generally accomplished by dropping a ball onto a ball seat that is located within the wellbore. The ball engages with the seat, and the seal created by this engagement prevents fluid communication into other zones downstream of the ball. As used herein, the term "downstream," with reference to a wellbore, means at a location farther away from the wellhead. The ball also engages a sliding sleeve located adjacent to a tubing string. Upon engagement with the sliding sleeve, the ball moves the sliding sleeve to open a fluid port from the wellbore into the subterranean formation. The stimulation treatment fluid is then introduced into the tubing string. The treatment fluid can then accomplish the desired stimulation treatment within the zone via the port.

In order to stimulate more than one zone using this technique, the wellbore contains more than one ball seat. For example, a ball seat can be located within each zone. Generally, the diameter of the tubing string where the ball seats are located is different for each zone. For example, the diameter of the tubing string sequentially decreases at each zone, moving from the wellhead to the bottom of the well. In this manner, a smaller ball is first dropped into a first zone that is the farthest downstream; that zone is stimulated; a slightly larger ball is then dropped into another zone that is located upstream of the first zone; that zone is then stimulated; and the process continues in this fashion—moving upstream along the wellbore—until all the desired zones have been stimulated. As used herein, the term "upstream," with reference to a wellbore, means at a location closest to the wellhead.

Some of the disadvantages to this process is that it is only possible to stimulate one zone at a time, and simultaneous stimulation of multiple zones is not possible. Additionally, the amount of incremental increase in the diameter of the tubing string containing each of the ball seats is limited by the strength of the ball and the ball seat, which limits the total number of zones that are capable of being stimulated. Moreover, stimulating different zones can only occur in one direction due to the sizing requirements of the tubing string containing the ball seats. For example, in order for the ball to drop all the way into the farthest downstream zone, the tubing string at that zone has the be the smallest. This means that stimulation must first be performed in the zone furthest downstream and then move in an upstream direction whereby additional zones may be stimulated. Therefore, stimulation can only be performed from a bottom-up direction.

If the zones are connected in parallel, then thief zones can still prevent the simultaneous stimulation of multiple zones. A thief zone is an area of a formation in which circulating fluids can be lost. The formation or extension of a fracture occurs suddenly. When this happens, the permeability of the subterranean formation at the location of the fracture is substantially increased. The fracture creates a thief zone. In order to maintain a balanced pressure in the wellbore, the flow rate of the fluid away from the wellbore and into the thief zone will increase. As a result, there is not a balanced flow rate of fluid between the different zones, and more of the fluid will enter the thief zone instead of stimulating other zones.

A flow rate restrictor can be used to variably restrict the flow rate of a fluid. A flow rate restrictor can also be used to deliver a relatively constant flow rate of a fluid within a given zone. A flow rate restrictor can also be used to deliver a relatively constant flow rate of a fluid between two or more zones. For example, a restrictor can be positioned in a wellbore at a location within a particular zone to regulate the flow rate of the fluid in that zone. More than one restrictor can be used within a particular zone. Also, a restrictor can be positioned in a wellbore at one location for one zone and another restrictor can be positioned in the wellbore at another location for a different zone in order to regulate the flow rate of the fluid between the two zones.

A novel method of simultaneously stimulating at least two zones of a subterranean formation includes flowing a fluid through at least a first and second flow rate restrictor. The flow rate restrictor can maintain the flow rate of the fluid exiting the restrictors as at least one property of the fluid changes in order to maintain a balanced flow rate of fluid within all of the zones.

According to an embodiment, a method of simultaneously stimulating at least a first zone and a second zone of a subterranean formation comprises: flowing a fluid through at least a first flow rate restrictor and a second flow rate restrictor, wherein: (A) the first flow rate restrictor is located adjacent to the first zone, (B) the second flow rate restrictor is located adjacent to the second zone, (C) the first and second flow rate restrictors are connected in parallel, and (D) as at least one of the properties of the fluid changes, the flow rates of the fluid exiting the first and second flow rate restrictors are similar within a flow rate range; and allowing the fluid to stimulate at least the first zone and the second zone.

According to another embodiment, a method of simultaneously stimulating at least a first zone and a second zone of a subterranean formation comprises: flowing a fluid through at least a first flow rate restrictor and a second flow rate restrictor, wherein: (A) the first flow rate restrictor is located adjacent to the first zone, (B) the second flow rate restrictor is located adjacent to the second zone, (C) the first and second flow rate restrictors are connected in parallel, (D) the first and second flow rate restrictors comprise a fluid inlet and a fluid outlet, (E) as at least one of the properties of the fluid changes, the pressure differential between the fluid inlet and the fluid outlet increases; and (F) as the pressure differential increases, the flow rate of the fluid exiting the fluid outlet is maintained within a flow rate range; and allowing the fluid to stimulate at least the first zone and the second zone.

Any discussion of the embodiments regarding the flow rate restrictor is intended to apply to all of the method embodiments. Any discussion of a particular component of an embodiment (e.g., a flow rate restrictor) is meant to include the singular form of the component and also the plural form of the component, without the need to continually refer to the component in both the singular and plural form throughout. For example, if a discussion involves "the flow rate restrictor 30," it is to be understood that the discussion pertains to one restrictor (singular) and two or more restrictors (plural).

The flow rate restrictor 30 and any component of the restrictor can be made from a variety of materials. Examples of suitable materials include, but are not limited to: metals, such as steel, aluminum, titanium, and nickel; alloys; plastics; composites, such as fiber reinforced phenolic; ceramics, such as tungsten carbide, boron carbide, synthetic diamond, or alumina; elastomers; and dissolvable materials.

The flow rate restrictor 30 can be autonomous, i.e., it is designed to automatically adjust the flow rate of the fluid exiting the restrictor based on a change in at least one property of the fluid without any external intervention.

Turning to the Figures, FIG. 1 depicts a well system 10 containing multiple flow rate restrictors 30 located within multiple zones of the well system. The methods include the step of flowing a fluid through at least a first and second flow rate restrictor 30. The fluid can be a homogenous fluid or a heterogeneous fluid. According to an embodiment, the fluid is a stimulation fluid. The fluid can be, for example, a fracturing fluid or an acidizing fluid. According to another embodiment, the methods include the step of flowing two or more fluids through at least the first and the second flow rate restrictors. The two or more fluids can be a stimulation fluid. The two or more fluids can be the same or different. By way of example, a first fluid can be a fracturing fluid and a second fluid can be an acidizing fluid. Fluids other than stimulation fluids can also be flowed through the first and/or second flow rate restrictors, for example, a wash fluid, gels, foams, etc. A first fluid can also be flowed through the first flow rate restrictor 30 and a second fluid can be flowed through the second flow rate restrictor 30.

As depicted in FIG. 1, the well system 10 can include at least one wellbore 11. The wellbore 11 can penetrate a subterranean formation 20. The subterranean formation 20 can be a portion of a reservoir or adjacent to a reservoir. The wellbore 11 can have a generally vertical uncased section 14 extending downwardly from a casing 15, as well as a generally horizontal uncased section extending through the subterranean formation 20. The wellbore 11 can include only a generally vertical wellbore section or can include only a generally horizontal wellbore section. The wellbore 11 can include a heel 12 and a toe 13.

A tubing string 24 (such as a stimulation tubing string or coiled tubing) can be installed in the wellbore 11. The well system 10 can comprise at least a first zone 16 and a second zone 17. The well system 10 can also include more than two zones, for example, the well system 10 can further include a third zone 18, a fourth zone 19, and so on. The methods can further comprise simultaneously stimulating the additional zones. According to an embodiment, the well system 10 includes anywhere from 2 to hundreds or thousands of zones. The zones can be isolated from one another in a variety of ways known to those skilled in the art. For example, the zones can be isolated via multiple packers 26. The packers 26 can seal off an annulus located between the outside of the tubing string 24 and the wall of wellbore 11.

The first flow rate restrictor 30 is located adjacent to the first zone 16 and the second flow rate restrictor 30 is located adjacent to the second zone 17. If more than two flow rate restrictors 30 are used, then a third flow rate restrictor 30 can be located adjacent to the third zone 18, the fourth flow rate restrictor 30 can be located adjacent to the fourth zone 19, etc. The methods can further include the step of flowing the fluid through at least the first, second, third, and fourth flow rate restrictors. Moreover, there can also be more than one flow rate restrictor 30 located adjacent to a particular zone, for example, located within adjacent pairs of packers 26 forming the first zone, etc.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a well screen. The flow rate restrictor 30 can be positioned adjacent to the well screen. By way of another example, cement may be used instead of packers 26 to isolate different zones. Cement may also be used in addition to packers 26.

The well system 10 does not need to include a packer 26. Also, it is not necessary for one well screen and one flow rate restrictor 30 to be positioned between each adjacent pair of the packers 26. It is also not necessary for a single flow rate restrictor 30 to be used in conjunction with a single well screen. Any number, arrangement and/or combination of these components may be used.

At least the first and second flow rate restrictors 30 are connected in parallel. If there are more than two restrictors used, then according to an embodiment, every flow rate restrictor 30 is connected in parallel. Not every zone needs to include a flow rate restrictor 30. However, it is to be understood that regardless of the total number and location of the flow rate restrictor 30, every restrictor is connected in parallel. The zones that contain the flow rate restrictor 30 can vary depending on the specifics of the oil or gas operation. By way of example, it may be desirable to only stimulate the zones located near the wellbore heel 12. According to this example, the zones located near the heel can contain the flow rate restrictor 30. In this manner, the step of flowing the fluid through the flow rate restrictor 30 would include flowing the fluid through the flow rate restrictor 30 located in the zones near the heel 12.

The methods are designed to provide simultaneous stimulation of at least the first zone 16 and the second zone 17 of the subterranean formation 20. More than two zones (i.e., the third zone 18, the fourth zone 19, etc.) can also be stimulated simultaneously. The stimulation can be the creation or extension of a fracture or an acidizing treatment. FIG. 1 depicts a fracture 22. One type of stimulation can be performed in one or more zones and a different type of stimulation can be performed in one or more different zones. There can also be more than one type of stimulation performed within a given zone.

The flow rate restrictor 30 can be positioned in the tubing string 24 in a manner such that a fluid inlet into the flow rate restrictor 30 is functionally oriented towards the tubing string 24. Therefore, the fluid 30 can flow from the tubing string 24, through the flow rate restrictor 30, and into the formation 20 in order to stimulate the formation at the desired zones.

The following examples illustrate a flow rate restrictor 30 according to certain embodiments. The following examples are not the only examples that could be given and are not intended to limit the scope of the invention.

Figure 2A:
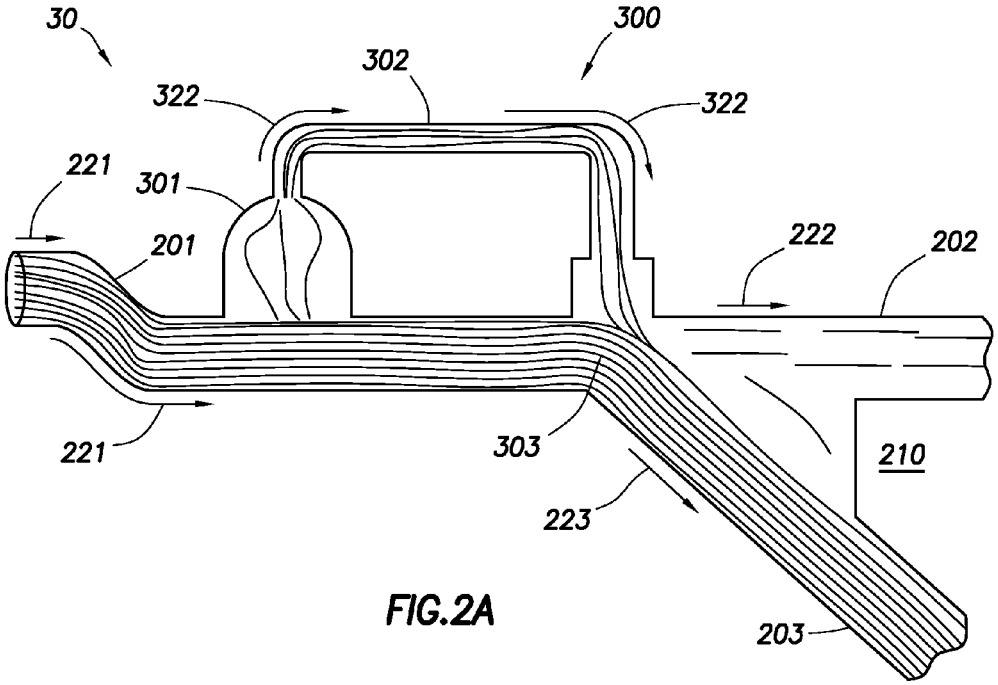
FIGS. 2A, 2B, and 3 depict a flow rate restrictor comprising a fluid direction device according to an embodiment.
Figure 2B:
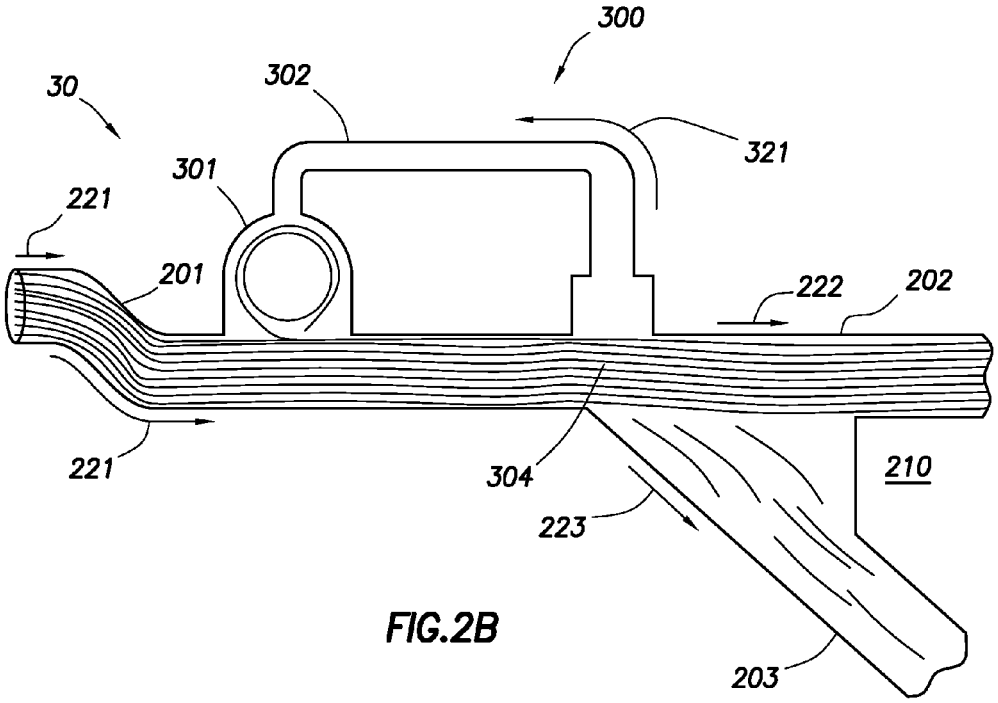
Figure 3:
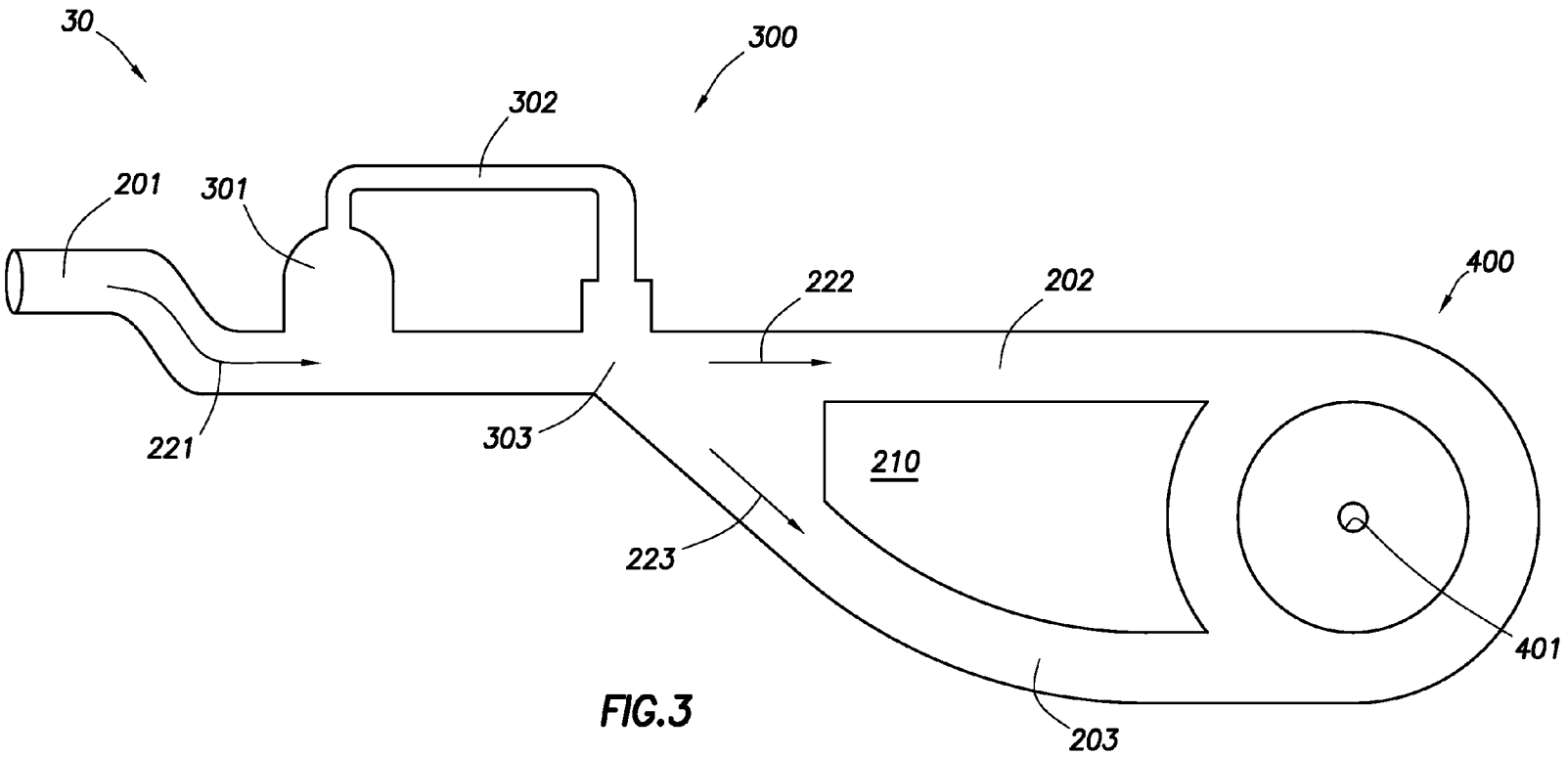

FIGS. 2A, 2B and 3 depict a flow rate restrictor 30 according to an embodiment. The flow rate restrictor 30 can include a first fluid passageway 201, a fluid direction device 300, and an exit assembly 400. The exit assembly 400 will be described in more detail below. The flow rate restrictor 30 can further include a second fluid passageway 202 and a third fluid passageway 203. The flow rate restrictor 30 can also include a fluid diverter 210. According to an embodiment, the first fluid passageway 201 branches into the second and third fluid passageways 202 and 203 at the fluid diverter 210. Although some of the Figures depict the second and third fluid passageways 202 and 203 connected to the first fluid passageway 201, it is to be understood that the second and third fluid passageways can be connected to other passageways instead. Any of the fluid passageways can be any shape including, tubular, rectangular, pyramidal, or curlicue in shape. Although illustrated as a single passageway, the first fluid passageway 201 (and any other passageway) could feature multiple passageways operatively connected in parallel.

The fluid direction device 300 can include a fluid selector 301, a fluid passageway 302, and a fluid switch 303. According to an embodiment, as at least one of the properties of the fluid changes, the amount of fluid that flows into the fluid selector 301 changes. The change can be that the fluid increasingly or decreasingly flows into the fluid selector 301.

The fluid can enter the flow rate restrictor 30 and flow through the first fluid passageway 201 in the direction of 221. The fluid traveling in the direction of 221 will have a specific flow rate and viscosity. The flow rate and/or viscosity of the fluid can change. According to an embodiment, the fluid selector 301 is designed such that as a property of the fluid changes, the fluid can increasingly flow into the fluid selector 301. For example, as the flow rate of the fluid decreases or as the viscosity of the fluid increases, then the fluid increasingly flows into the fluid selector 301. Regardless of the dependent property of the fluid (e.g., the flow rate of the fluid or the viscosity of the fluid), as the fluid increasingly flows into the fluid selector 301, the fluid increasingly flows in the direction of 322. FIG. 2A illustrates fluid flow through the flow rate restrictor 30 when the flow rate of the fluid in the first fluid passageway 201 is low or decreases, or when the viscosity of the fluid is higher or increases. The fluid flowing in the direction of 322 can flow into the third fluid passageway 203.

According to another embodiment, as the flow rate of the fluid in the first fluid passageway 201 increases or as the viscosity of the fluid decreases, then the fluid decreasingly flows into the fluid selector 301. As the fluid decreasingly flows into the fluid selector 301, the fluid increasingly flows in the direction of 321. FIG. 2B illustrates fluid flow through the system when the flow rate of the fluid in the first fluid passageway 201 increases or when the viscosity of the fluid decreases. The fluid flowing in the direction of 321 can flow into the second fluid passageway 202.

Figure 5:
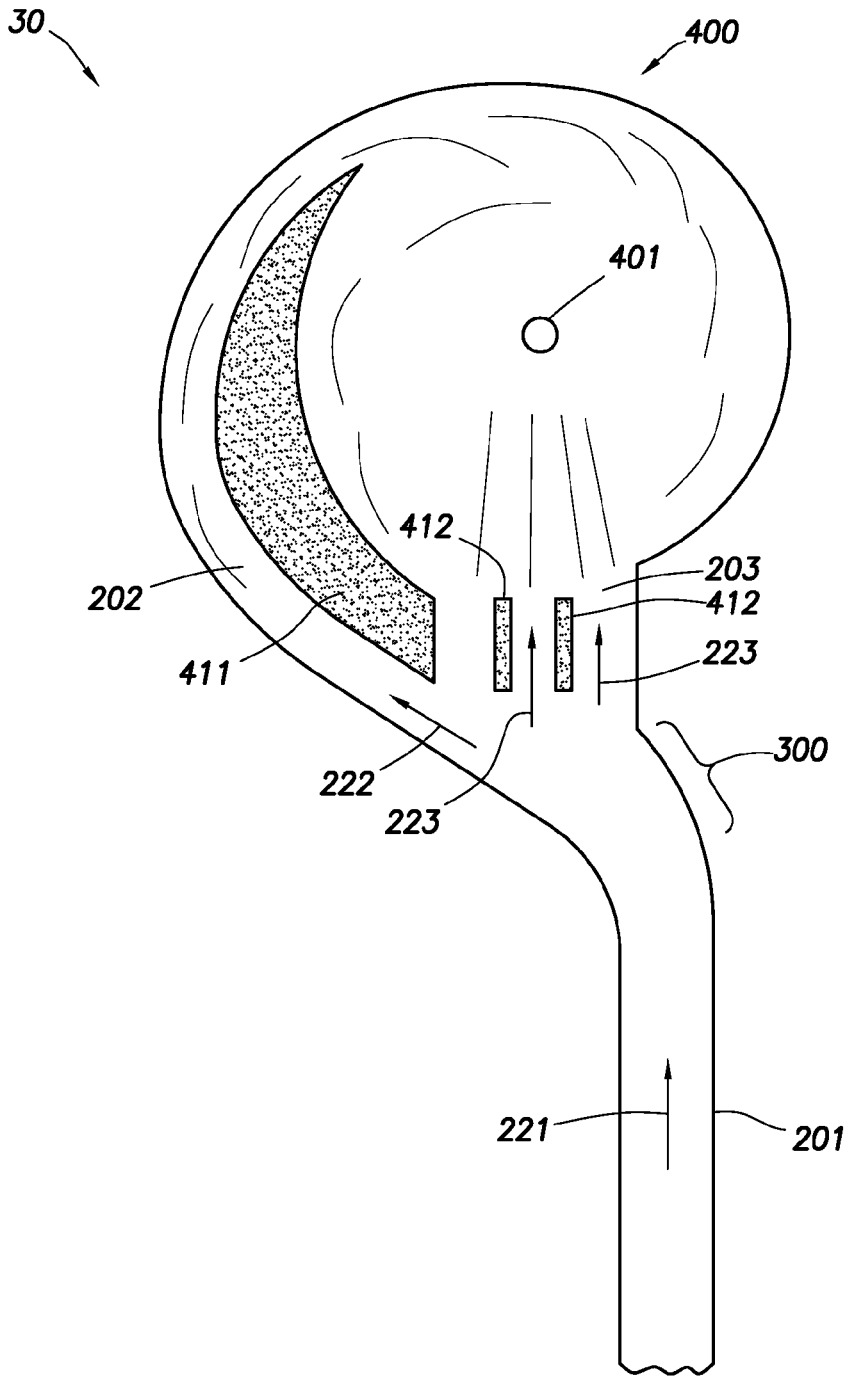
FIG. 5 depicts a flow rate restrictor comprising a fluid direction device and an exit assembly according to another embodiment.

The fluid direction device 300 can direct the fluid into at least the second fluid passageway 202, the third fluid passageway 203, and combinations thereof. The fluid direction device 300 can include a fluid switch 303. According to an embodiment, the fluid switch 303 directs the fluid into the exit assembly 400 in the direction of 222, 223, and combinations thereof. The fluid switch 303 can be any type of fluid switch that is capable of directing a fluid from one fluid passageway into two or more different fluid passageways or directing the fluid into the exit assembly 400 in two or more different directions. Examples of suitable fluid switches include, but are not limited to, a pressure switch, a mechanical switch, an electro-mechanical switch, an electro-ceramic switch, a momentum switch, a fluidic switch, a bistable amplifier, and a proportional amplifier. FIGS. 2A-3 depict an example of a pressure switch. FIG. 5 is an example of a momentum switch.

The fluid switch 303 can direct a fluid into two or more different fluid passageways or into the exit assembly 400 in two or more different directions. In certain embodiments, the fluid switch 303 directs the fluid based on at least one of the physical properties of the fluid. In other embodiments, the fluid switch 303 directs the fluid based on an input from an external source. For example, a downhole electronic system or an operator can cause the fluid switch 300 to direct the fluid. The fluid switch 303 can direct an increasing amount of the fluid into the second fluid passageway 202 when the flow rate of the fluid in the first fluid passageway 201 increases and can direct an increasing amount of the fluid into the third fluid passageway 203 when the flow rate of the fluid in the first fluid passageway 201 decreases. By way of another example, the fluid switch 303 can direct an increasing amount of the fluid into the exit assembly 400 in the direction of 222 when the flow rate of the fluid in the first fluid passageway 201 increases and can direct an increasing amount of the fluid into the exit assembly in the direction of 223 when the flow rate of the fluid of the fluid in the first fluid passageway 201 decreases.

Figure 4A:
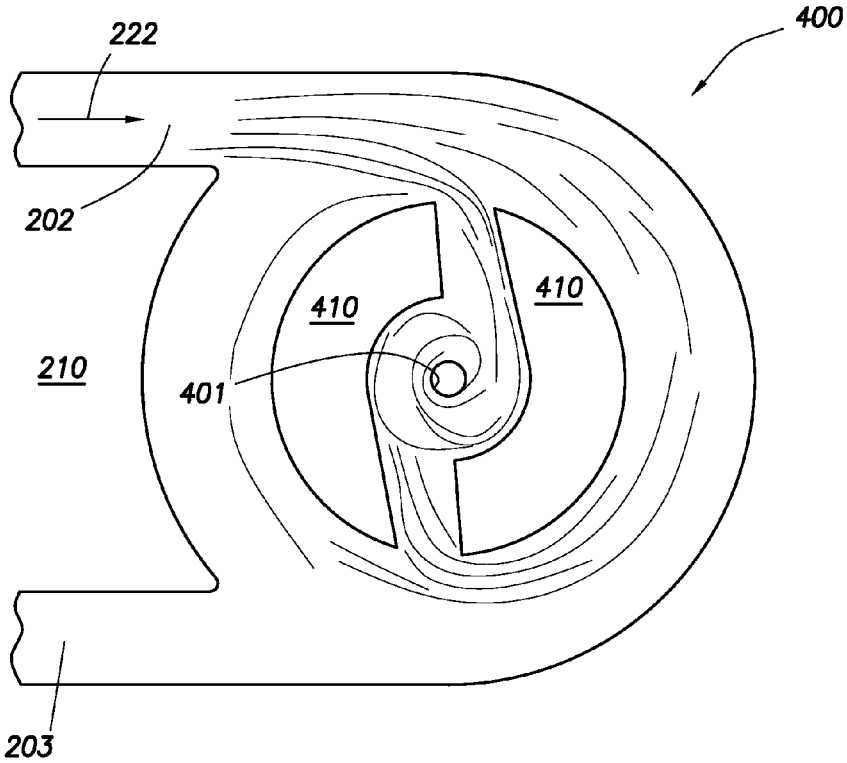
FIGS. 4A and 4B depict a flow rate restrictor comprising an exit assembly according to an embodiment.
Figure 4B:
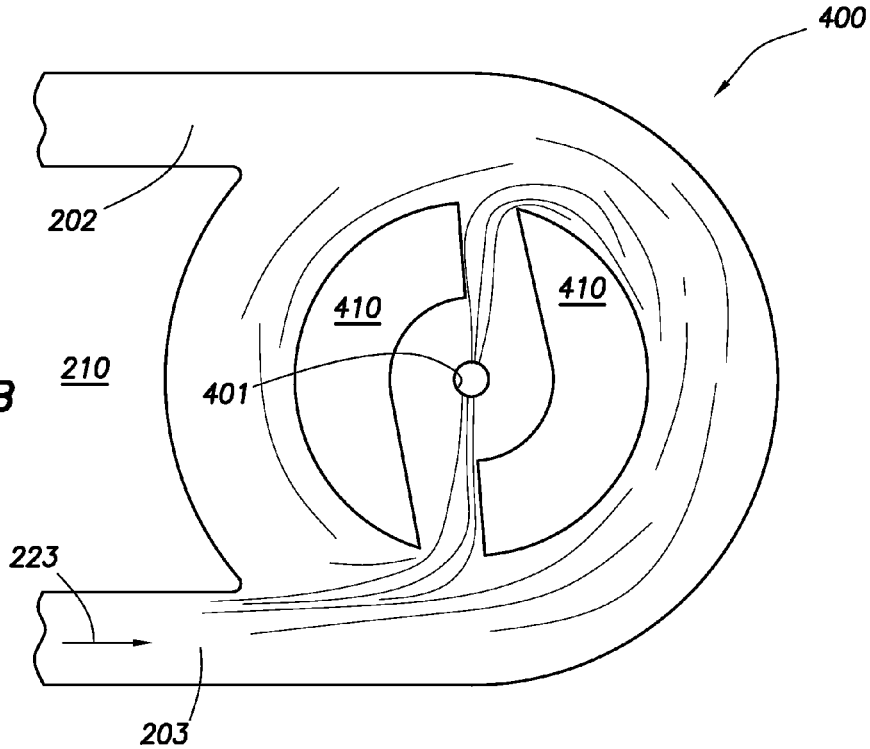

FIGS. 4A, 4B, and 5 depict the exit assembly 400 according to certain embodiments. The exit assembly 400 can include a fluid outlet 401. According to an embodiment, the direction of 223 can be a direction that is radial to the fluid outlet 401. In this manner, the fluid, when entering the exit assembly 400 in the direction of 223 will flow through the exit assembly 400 in a relatively non-rotational direction. As can also be seen, the direction of 222 can be a direction that is tangential relative to a radius of the fluid outlet 401. In this manner, the fluid, when entering the exit assembly 400 in the direction of 222 can flow rotationally about the inside of the exit assembly 400.

According to an embodiment, the fluid flowing in the direction of 223 will axially flow towards the fluid outlet 401. In this manner, the fluid can exit the exit assembly 400 via the fluid outlet 401. As the fluid increasingly flows through the exit assembly 400 in a direction axial to the fluid outlet 401, the resistance to fluid flow through the exit assembly 400 and the fluid outlet 401 decreases. As the volume of fluid flowing in the axial direction increases, the pressure differential between a fluid inlet of the first fluid passageway 201 (not labeled) and the fluid outlet 401 decreases.

According to another embodiment, the fluid flowing in the direction of 222, will flow rotationally about the fluid outlet 401. According to an embodiment, as the fluid increasingly flows rotationally about the exit assembly 400, the resistance to fluid flow through the exit assembly 400 and the fluid outlet 401 increases. As the volume of fluid flowing in the rotational direction increases, the pressure differential between a fluid inlet (not labeled) of the first fluid passageway 201 and the fluid outlet 401 increases. According to an embodiment, as the pressure differential increases, the flow rate of the fluid exiting the fluid outlet 401 is maintained within a flow rate range.

As depicted in FIGS. 4A and 4B, the exit assembly 400 can include at least one fluid director 410. The exit assembly can also include two or more fluid directors. According to an embodiment, and as depicted in FIGS. 4A and 4B, the fluid director 410 induces flow of the fluid rotationally about the exit assembly 400 and also impedes flow of the fluid rotationally about the exit assembly 400. According to an embodiment, the fluid director 410 induces flow of the fluid rotationally about the exit assembly 400 when the fluid enters via the second fluid passageway 202 or in the direction of 222; and impedes flow of the fluid rotationally about the exit assembly 400 when the fluid enters via the third fluid passageway 203 or in the direction of 223. According to another embodiment, the size and shape of the fluid director 410 is selected such that the fluid director: induces flow of a fluid rotationally about the exit assembly 400 when the fluid enters via the second fluid passageway 202 or in the direction of 222; and impedes flow of the fluid rotationally about the exit assembly 400 when the fluid enters via the third fluid passageway 203 or in the direction of 223.

If at least two fluid directors 410 are used, the fluid directors do not have to be the same size or the same shape. The shape of the fluid director 410 can be any shape that induces and impedes rotational flow of a fluid. It is to be understood that the shapes depicted in the drawings are not the only shapes that are capable of achieving the desired result of inducing and impeding rotational flow of a fluid. Moreover, multiple shapes can be used within a given exit assembly 400.

According to another embodiment and as can be seen in FIG. 5, the exit assembly 400 can include a first fluid director 411 and a second fluid director 412. The first fluid director 411 can induce rotational flow about the exit assembly 400 and the second fluid director 412 can impede rotational flow about the exit assembly 400. There can be more than one first fluid director 411 and/or there can be more than one second fluid director 412.

Figure 6:
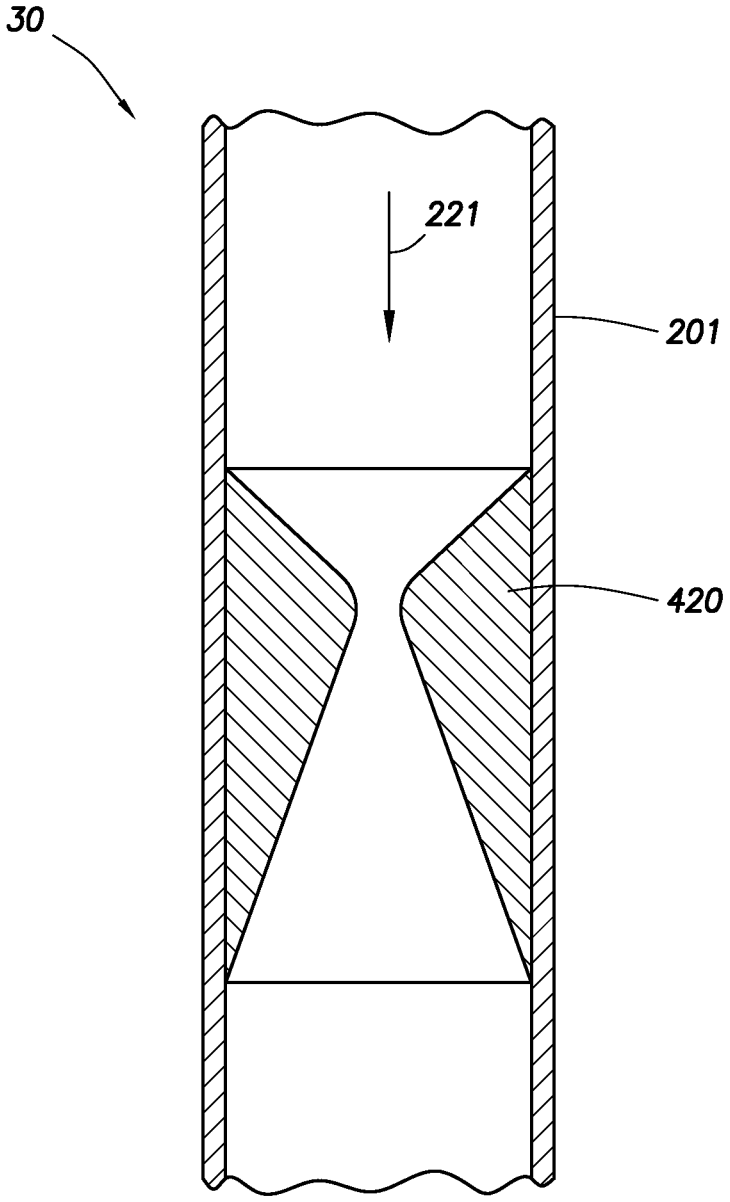
FIG. 6 depicts a flow rate restrictor according to another embodiment.

FIG. 6 depicts a flow rate restrictor 30 according to yet another embodiment. The flow rate restrictor 30 can comprise the first fluid passageway 201 and a constriction 420. The constriction can be a plate that is capable of moving closer to and farther away from a fluid port. In this manner, as the flow rate of the fluid increases, the plate can move closer to the port, thus maintaining the flow rate of the fluid exiting the restrictor within the flow rate range. The cross-sectional area of the constriction 420 is less than the cross-sectional area of the first fluid passageway 201. A pressure differential can be created via the constriction 420 within the first fluid passageway 201. A first pressure can exist at a location upstream of the constriction 420 and a second pressure can exist at a location adjacent to the constriction 420. As used herein, the term "upstream," with reference to the constriction 420, means closer to the fluid source and is in the opposite direction of fluid flow. The pressure differential can be calculated by subtracting the second pressure from the first pressure. There can also be a first fluid flow rate at a location upstream of the constriction 420 and a second fluid flow rate at a location adjacent to the constriction 420. According to the Venturi effect, the second flow rate of the fluid increases as the cross-sectional area of the fluid passageway decreases at the constriction 420. As the second flow rate increases, the second pressure decreases, resulting in an increase in the pressure differential.

The flow rate restrictor 30 according to the embodiment depicted in FIG. 6 can maintain the flow rate of the fluid exiting the first fluid passageway 201 by choking the flow of the fluid. At initially subsonic upstream conditions, the conservation of mass principle requires the fluid flow rate to increase as it flows through the smaller cross-sectional area of the constriction. At the same time, the Venturi effect causes the second pressure to decrease at the constriction. For liquids, choked flow occurs when the Venturi effect acting on the liquid flow through the constriction decreases the liquid pressure to below that of the liquid vapor pressure at the temperature of the liquid. At that point, the liquid will partially flash into bubbles of vapor. As a result, the formation of vapor bubbles in the liquid at the constriction limits the flow rate from increasing any further. The cross-sectional area of the constriction 420 can be adjusted to maintain the flow rate of the fluid within the flow rate range. However, depending on the cross-sectional area of the constriction 420, a fluid containing undissolved solids, such as proppant, may encounter difficulty flowing through the constriction 420. Therefore, the type of flow rate restrictor 30 selected may depend on the type of fluid being used for the stimulation.

The following examples illustrate possible uses of the flow rate restrictor 30 to simultaneously stimulate two or more zones of a subterranean formation. The following examples are not the only examples that could be given and are not intended to limit the scope of the invention. The methods provide simultaneous stimulation of at least the first zone 16 and the second zone 17. Although FIG. 1 depicts the first zone 16 and the second zone 17 being located near the heel 12, the use of "first" and "second" are arbitrarily assigned and are not meant to depict a specific location or arrangement. For example, the first zone 16 and the second zone 17 do not have to be adjacent to one another. Moreover, the first zone 16 and the second zone 17 could be located in the middle portion of the wellbore 11 or closer to, or at, the toe 13.

According to an embodiment, as at least one of the properties of the fluid changes, the flow rates of the fluid exiting the first and second flow rate restrictors 30 (and any additional restrictors) are similar within a flow rate range. As used herein, the term "similar" means the same or substantially the same. The flow rate of the fluid exiting the first flow rate restrictor can be the same as the flow rate of the fluid exiting the second flow rate restrictor that is within the flow rate range. For example, if the flow rate range is selected to be from 0 to about 50 gallons per minute (gpm), then the flow rates of the fluid exiting the restrictors can be at least one rate within the flow rate range (e.g., flow rates of 10 gpm). The exact flow rates within the range can change, for example before stimulation, during stimulation and after stimulation. However, it is to be understood that regardless of the exact flow rates within the range, the flow rates of the fluid exiting at least the first and second flow rate restrictors are similar. Moreover, the flow rate of the fluid exiting the first flow rate restrictor can be substantially the same as the flow rate of the fluid exiting the second flow rate restrictor that is within the flow rate range. The substantially the same flow rates can be within +/−50% of each other, preferably +/−25% and more preferably +/−10% of each other. According to an embodiment at least two of the flow rates exiting at least two flow rate restrictors are similar within the flow rate range. More than two flow rates exiting more than two restrictors can be similar. Moreover, a first set of flow rates can be similar and then a second set of flow rates can be similar. For example, if it is desirable to stimulate a first set of zones (e.g., zones 1 through 5), then the flow rates exiting the flow rate restrictors located in the first set of zones are similar. In the event it is then desirable to stimulate a second (and possibly a third, fourth, etc.) zone, then the flow rates exiting the flow rate restrictors located in the second (third, fourth, etc.) zone are similar. According to another embodiment, as at least one of the properties of the fluid changes, the pressure differential between a fluid inlet and the fluid outlet 401 of the flow rate restrictor 30 increases, and as the pressure differential increases, the flow rate of the fluid exiting the fluid outlet is maintained within a flow rate range.

The flow rate range can be predetermined. According to an embodiment, the minimum end of the flow rate range is less than the rate necessary to stimulate the desired zones. The maximum end of the flow rate range can be a rate such that a sufficient amount of pressure is maintained in order to stimulate the desired zones. According to another embodiment, the flow rate range is from about 0.1 gpm to about 20 gpm. In another embodiment, the flow rate range is from about 0.5 gpm to about 3 gpm.

The property of the fluid that changes can be the flow rate of the fluid flowing through the first fluid passageway 201, the viscosity of the fluid, or both. As at least one of the properties of the fluid changes, the flow rates of the fluid exiting the flow rate restrictor 30, via the fluid outlet 401 for example, are similar within the flow rate range. By way of example, the flow rate restrictor 30 can be designed such that when the flow rate of the fluid in the first fluid passageway 201 is below the predetermined maximum flow rate (e.g., prior to stimulation commencing), then the fluid direction device 300 can direct the fluid to substantially flow into the third fluid passageway 203, enter the exit assembly 400 in the direction of 223, flow axially towards the fluid outlet 401, wherein the pressure differential is lower compared to the following example, the resistance to fluid flow out of the exit assembly 400 is reduced, and thus the flow rate of the fluid exiting the exit assembly 400 is similar to the flow rate of the fluid exiting other flow rate restrictors within the flow rate range. By way of another example, the flow rate restrictor 30 can be designed such that when the flow rate of the fluid in the first fluid passageway 201 increases above the predetermined maximum flow rate (e.g., after stimulation has commenced or has been completed), then the fluid direction device 300 can direct the fluid to increasingly flow into the second fluid passageway 202, enter the exit assembly 400 in the direction of 222, flow rotationally about the exit assembly 400, wherein the pressure differential increases, the resistance to fluid flow out of the exit assembly 400 increases, and thus the flow rate of the fluid exiting the exit assembly 400 is similar to the flow rate of the fluid exiting other flow rate restrictors and the flow rates are maintained within (or possibly reduced to within) the flow rate range. According to another example referring to the flow rate restrictor 30 depicted in FIG. 6, as the flow rate of the fluid reaches a sonic rate, the formation of vapor bubbles makes the flow rate of the fluid exiting the restrictor similar to the flow rates of other restrictors within the flow rate range.

The property that changes can also be the viscosity of the fluid. One or more zones can be stimulated, while other zones are not stimulated or are stimulated at a later time. By way of example, if it is desirable to stimulate a first set of zones located closest to the toe 13 first, then as shown in FIG. 1, the flow rate restrictors 30 located in the zone (not labeled) at the toe 13 and the fourth zone 19 can be designed such that when the viscosity of the fluid is within a range, the flow rate restrictors 30 in those zones are in an open position. That is, the fluid, such as a fracturing fluid, will substantially flow into the third fluid passageway 203, enter the exit assembly 400 in the direction of 223, and flow out of the fluid outlet 401 with little resistance. Those zones are then stimulated wherein the flow rates of the fluid exiting these restrictors are similar within the flow rate range. The flow rate restrictors 30 in the first set of zones can also be designed such that an increase in the flow rate of the fluid entering the first fluid passageway 201 during or after stimulation causes the restrictors to maintain the flow rate of the fluid exiting the restrictor within the flow rate range, as discussed above. Now that the first set of zones located closest to the toe 13 have been stimulated, the viscosity of the fluid can be decreased to fall within a second viscosity range. The flow rate restrictors 30 located in a second set of zones located upstream of the fourth zone 19 (e.g., the third zone 18, the second zone 17, and/or the first zone 16) can then be stimulated. Those flow rate restrictors 30 can be designed such that when the viscosity of the fluid is within the second viscosity range, the flow rate restrictors 30 in the second set of zones are in an open position. This process can be repeated, using as many viscosity ranges as necessary, to stimulate the desired zones or sets of zones of the subterranean formation 20. The exact pattern of stimulation can vary and can be dependent on the specifics of the oil or gas operation. For example, the zones located closest to the toe 13 may be stimulated first, and then subsequent zones can be stimulated moving back towards the heel 12. Conversely, the zones located in the middle may be stimulated first and then the heel 12 and the toe 13 stimulated afterwards.

Some of the advantages to using the methods include: a more balanced flow rate can be achieved among all the zones; a more controlled stimulation can be performed; and for fracturing, all of the fractures can be created at the same fracture formation rate, and the overall dimensions of each fracture can be controlled to help prevent the fracture from penetrating into an adjacent reservoir.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of simultaneously stimulating at least a first zone and a second zone of a subterranean formation comprising:

flowing a fluid through at least a first flow rate restrictor and a second flow rate restrictor, wherein:

the first flow rate restrictor is located adjacent to the first zone, the second flow rate restrictor is located adjacent to the second zone, the first and second flow rate restrictors are connected in parallel, and as at least one of the properties of the fluid changes, the flow rates of the fluid exiting the first and second flow rate restrictors are similar within a flow rate range;

allowing the fluid to stimulate at least the first zone and the second zone, wherein:

at least one of the first and the second flow rate restrictors comprise a first fluid passageway, a fluid direction device, and an exit assembly;

the fluid direction device comprises a fluid switch that is capable of directing the fluid from the first fluid passageway into the exit assembly in at least a first and a second direction;

the fluid switch directs an increasing amount of the fluid into the exit assembly in the first direction when the flow rate of the fluid in the first fluid passageway increases and directs an increasing amount of the fluid into the exit assembly in the second direction when the flow rate of the fluid of the fluid in the first fluid passageway decreases, and the fluid entering the exit assembly in the first direction flows rotationally about the inside of the exit assembly.

2. The method according to claim 1, wherein the fluid is an acidizing fluid.

3. The method according to claim 1, wherein the fluid is a heterogeneous fluid.

4. The method according to claim 3, wherein the fluid is a fracturing fluid.

5. The method according to claim 1, wherein the step of flowing further comprises flowing two or more fluids through at least the first and the second flow rate restrictors.

6. The method according to claim 1, further comprising a third flow rate restrictor, wherein the third flow rate restrictor is located adjacent to a third zone, and a fourth flow rate restrictor, wherein the fourth flow rate restrictor is located adjacent to a fourth zone.

7. The method according to claim 6, further comprising the step of flowing the fluid through at least the first, second, third, and fourth flow rate restrictors.

8. The method according to claim 6, wherein at least the first, second, third and fourth flow rate restrictors are connected in parallel.

9. The method according to claim 1, wherein at least one of the first and the second flow rate restrictors are an autonomous flow rate restrictor.

10. The method according to claim 1, wherein the fluid entering the exit assembly in the second direction flows through the exit assembly in an axial direction.

11. The method according to claim 10, wherein the exit assembly comprises at least one fluid director, wherein the fluid director induces flow of the fluid rotationally about the exit assembly and also impedes flow of the fluid rotationally about the exit assembly.

12. The method according to claim 11, wherein the size and shape of the fluid director is selected such that the fluid director: induces flow of a fluid rotationally about the exit assembly when the fluid enters the exit assembly in the first direction; and impedes flow of the fluid rotationally about the exit assembly when the fluid enters the exit assembly in the second direction.

13. The method according to claim 11, wherein the exit assembly comprises a first fluid director and a second fluid director, wherein the first fluid director induces rotational flow of the fluid about the exit assembly and the second fluid director impedes rotational flow of the fluid about the exit assembly.

14. The method according to claim 1, wherein at least one of the first and the second flow rate restrictors comprises a constriction.

15. The method according to claim 14, wherein the cross-sectional area of the constriction is less than the cross-sectional area of the first fluid passageway.

16. A method of simultaneously stimulating at least a first zone and a second zone of a subterranean formation comprising:

flowing a fluid through at least a first flow rate restrictor and a second flow rate restrictor, wherein:

(A) the first flow rate restrictor is located adjacent to the first zone, (B) the second flow rate restrictor is located adjacent to the second zone, (C) the first and second flow rate restrictors are connected in parallel, (D) the first and second flow rate restrictors comprise a fluid inlet and a fluid outlet, (E) as at least one of the properties of the fluid changes, the pressure differential between the fluid inlet and the fluid outlet increases; and (F) as the pressure differential increases, the flow rate of the fluid exiting the fluid outlet is maintained within a flow rate range; and allowing the fluid to stimulate at least the first zone and the second zone, wherein:

at least one of the first and the second flow rate restrictors comprise a first fluid passageway, a fluid direction device, and an exit assembly;

the fluid direction device comprises a fluid switch that is capable of directing the fluid from the first fluid passageway into the exit assembly in at least a first and a second direction;

the fluid switch directs an increasing amount of the fluid into the exit assembly in the first direction when the flow rate of the fluid in the first fluid passageway increases and directs an increasing amount of the fluid into the exit assembly in the second direction when the flow rate of the fluid of the fluid in the first fluid passageway decreases; and the fluid entering the exit assembly in the second direction flows through the exit assembly in an axial direction.

* * * * *